US008807335B2

(12) United States Patent
Nilsson

(10) Patent No.: US 8,807,335 B2
(45) Date of Patent: Aug. 19, 2014

(54) SECURITY DEVICE

(75) Inventor: Thomas Nilsson, Malmö (SE)

(73) Assignee: MW Security AB, Malmo (SE)

( * ) Notice: Subject to any disclaimer, the term of this patent is extended or adjusted under 35 U.S.C. 154(b) by 184 days.

(21) Appl. No.: 12/528,485

(22) PCT Filed: Mar. 13, 2008

(86) PCT No.: PCT/EP2008/053050

§ 371 (c)(1),
(2), (4) Date: Nov. 25, 2009

(87) PCT Pub. No.: WO2008/110617

PCT Pub. Date: Sep. 18, 2008

(65) Prior Publication Data

US 2010/0320103 A1 Dec. 23, 2010

(30) Foreign Application Priority Data

Mar. 13, 2007 (EP) ..... 07104070

(51) Int. Cl.
*B65D 85/57* (2006.01)
*A47F 7/024* (2006.01)
*E05B 73/00* (2006.01)

(52) U.S. Cl.
CPC ..... *E05B 73/0023* (2013.01); *A47F 7/0246* (2013.01)
USPC ..... 206/308.2; 206/1.5

(58) Field of Classification Search
CPC ..... E05B 73/0023; G11B 23/023; G11B 33/0411; Y10S 206/807
USPC ..... 206/18, 583, 387.11, 387.12, 308.2, 206/807, 1.5, 586; 220/8, 345.4, 4.21; 70/57.1, 19
See application file for complete search history.

(56) References Cited

U.S. PATENT DOCUMENTS

| | | | | | |
|---|---|---|---|---|---|
| 3,979,011 | A | * | 9/1976 | Schleicher | 220/742 |
| 4,216,857 | A | | 8/1980 | Huang | |
| 5,147,034 | A | | 9/1992 | Broadhead et al. | |
| 5,360,107 | A | * | 11/1994 | Chasin et al. | 206/313 |
| 5,368,162 | A | * | 11/1994 | Holmgren | 206/387.11 |
| 5,375,712 | A | * | 12/1994 | Weisburn | 206/387.11 |
| 5,511,659 | A | * | 4/1996 | Bosworth | 206/308.1 |
| 5,524,752 | A | * | 6/1996 | Mazzucchelli | 206/308.2 |

(Continued)

FOREIGN PATENT DOCUMENTS

| | | |
|---|---|---|
| EP | 0458721 | 4/1991 |
| EP | 0508201 | 3/1992 |

(Continued)

OTHER PUBLICATIONS

International Search Report corresponding to PCT/EP2008/053050, mailed Jul. 1, 2008.

(Continued)

*Primary Examiner* — David Fidei
(74) *Attorney, Agent, or Firm* — Renner, Otto, Boisselle & Sklar LLP

(57) ABSTRACT

The invention relates to an anti-theft safer for a cassette comprising a cassette receiving case and a locking device being adapted to releasably secure the cassette in the case, wherein the cassette receiving case is a two-part case.

15 Claims, 6 Drawing Sheets

(56) References Cited

U.S. PATENT DOCUMENTS

| | | | | | |
|---|---|---|---|---|---|
| 5,680,782 | A | * | 10/1997 | Komatsu et al. | 70/57.1 |
| 5,799,784 | A | * | 9/1998 | Bosworth | 206/308.1 |
| 5,802,890 | A | * | 9/1998 | Espada-Velasco | 70/57.1 |
| 5,882,052 | A | | 3/1999 | Whitehead | |
| 6,082,156 | A | * | 7/2000 | Bin | 70/57.1 |
| 6,116,062 | A | * | 9/2000 | Markegard et al. | 70/19 |
| 6,412,633 | B1 | * | 7/2002 | Costa | 206/459.5 |
| 6,931,895 | B1 | * | 8/2005 | Ahn | 70/57.1 |
| 6,955,068 | B2 | * | 10/2005 | Gelardi | 70/58 |
| 7,219,362 | B2 | * | 5/2007 | Beckwith et al. | 720/736 |
| 7,225,921 | B2 | * | 6/2007 | Pelczarski et al. | 206/308.1 |
| 7,322,467 | B2 | * | 1/2008 | Youngblood | 206/233 |
| 7,624,862 | B1 | * | 12/2009 | Pleggenkuhle | 206/349 |
| 7,798,321 | B2 | * | 9/2010 | Wynalda et al. | 206/308.1 |

FOREIGN PATENT DOCUMENTS

| | | |
|---|---|---|
| EP | 1 070 473 A1 | 1/2001 |
| GB | 2 346 870 | 8/2000 |
| JP | 08 266380 | 10/1996 |
| RU | 26275 | 11/2002 |
| WO | 00/75469 | 12/2000 |

OTHER PUBLICATIONS

European Extended Search Report for corresponding European Application No. 07104070.3.

Decision to grant for corresponding Russian application No. 2009137775.

* cited by examiner

Section A-A
Detail B
10
20a
20b
21
22
23
24
25
26
30
31
A
B 20a
24
23
25
26
20b
24

10
26
23
20a
A
24
26
25
23
22
21
20b
A
24
26
23
10
B
Section A-A 20a
24
21
23
30
31
Detail B
22
31
20b
24

22
24
20a
20b
10
27
31

Section A-A
Detail B

DISC
11
10
20a
20b
21
22
23
24
30
31, 40
A

SECURITY DEVICE

TECHNICAL FIELD OF THE INVENTION

The present invention relates to a security device, i.e. an anti-theft safer for a cassette comprising a cassette receiving case and a locking device being adapted to releasably secure the cassette in the case. The cassette receiving case is a two-part case comprising a first cassette receiving part and a second cassette receiving part, which parts are adapted to releasably lock together with the locking device for forming the case.

DESCRIPTION OF RELATED ART

Nowadays safers are used for securing for example parallellepipedic cassettes, particularly for such cassettes that are used for CD:s, DVD:s, videotapes, computer games and game consoles or the like. A safer is a security device that is mounted on the cassette and locked to the cassette so that the cassette only can be removed from the safer by authorized persons as safers are used in shops and malls for preventing cassette thefts, i.e. removing of cassettes from the shop without paying for them, and for this purpose the safer is provided with an element which trigger an alarm if the safer is moved from the shop or a defined area in the mall.

When protecting goods, one must balance the grade of security with cost and appealing looks, i.e. consumers want to be able to see the contents of a package before buying a package. It is well known to use a number of solutions in order to protect goods and to display the contents at the same time, such as lockable transparent boxes having a cassette receiving case and a locking device being adapted to releasable secure the cassette in the case. Such a box or case is disclosed in for example EP-A1-1 070 473. This solution provides means to protect a cassette, a package or a box from being opened by an unauthorized person, i.e. tampered with, by providing a cassette with an anti-theft safer in the form of an outer additional case.

However, this known solution requires a complicated device with several separate items made of different materials, e.g. a locking device in the form of a separate cover being detachable and separable from the case, which are assembled together in several steps to form the cassette safer case and that must work together to create this known anti-theft safer case. Moreover, such prior art safers are difficult to handle as the cassettes have to be inserted in narrow openings when put into the safer and there is no guiding means that guides the cassette before insertion therein requiring complicated manipulation both when inserting the cassette in the safer case and when removing the cassette from the safer case. This is due to the fact that known safers are formed by at least two separate parts that have to be held and manipulated individually, especially safers having a case and a locking device in the form of a tongue. In EP-A1-1 070 473, the case and the detachable cover forming a lid on the case when locking a cassette are not interconnected such that they form a unit, in other words, they are movable in relation to each other but they are not always coupled together during use causing a complicated manipulation of the loose cover lid when a cassette is to be removed from or inserted into the case. Furthermore, the known safers require a lot of effort during use due to the separate and loose parts when the safer is detached and assembled and also a lot of material due to the fact that the safer cases, in some cases, must have at least three sides fully enclosed. Such solutions also often require transparent safer cases for exposing the cassette to a desirable extent. They also require safer cases and locking devices that have certain dimensions relating to certain cassettes, whereby for example, if necessary, a safer caser for a DVD cassette can not securely hold a CD-cassette if the CD safer cases are out of stock. Moreover, if the prior art safer case is broken, the whole case must be replaced due to the fact that the safer case is a one-piece item. Prior art safers are therefore expensive to manufacture, to put together, and maintain, and bulky, occupying unnecessary space. More specifically, these prior art safers having separate and loose parts when the safer is opened and disassembled for receiving a cassette or to be stored as an empty safer in parts before reloading it with a new cassette are cumbersome to handle, e.g. as both hands for a cashier at a pay desk will be occupied or used when storing the separated and loose parts of this safer individually after opening and removing a cassette that is to be sold

SUMMARY

An overall object of the invention is therefore to provide a simplified construction for a security device in the form of an anti-theft and tamper-proof safer, which comprises a two-part case with a locking device.

This object as well as further objects that will be apparent to the skilled man by the description which follows are achieved according to the invention by a security device of the kind referred to above, which is characterized by the features of the independent claims. Further features of the invention are defined in the dependent claims.

The security device of the present invention fulfils this object by means of an anti-theft safer for a cassette comprising a cassette receiving case and a locking device being adapted to releasably secure the cassette in the case. The case is a two-part case comprising a first cassette receiving part and a second cassette receiving part, which parts are adapted to releasably lock together with the locking device for securing the cassette in the case. The cassette receiving parts are always coupled together after assembly for forming the case both in the cassette securing position when the locking device is locked in a closed state of the safer and during cassette release or insertion when the locking device is unlocked in an open state of the safer.

In one embodiment of the anti-theft safer, the case forming and cassette receiving parts are movably interconnected, such that the parts are displaceable in opposite directions in relation to each other in the open state of the safer when the locking device is unlocked and fixed in relation to each other in the closed state of the safer when the locking device is locked.

In another embodiment, the first cassette receiving part has a female member extending in the direction of movement for the two cassette receiving parts and facing a male member of the second cassette receiving part, which female and male members are configured for displaceable interconnection in opposite directions.

In yet another embodiment, the female and male members together form an intermediate case back.

In still another embodiment, the locking device is an integrated part of the cassette receiving case, and, in one other embodiment, the locking device is an integrated part of the cassette receiving case back.

The cassette receiving parts in one embodiment are coupled together by engagement between the locking device and a retaining device both when the locking device is locked and when the locking device is unlocked.

In yet another embodiment, one of the cassette receiving parts is provided with the retaining device for engagement with the locking device on the other part for holding the parts together, and in another embodiment, one of the members is provided with the retaining device for engagement with the locking device on the other member for holding the members together.

Each of the parts of the two-part case in one embodiment has substantially the shape of a T or, in another embodiment, the shape of a L, and, in which shape, in yet another embodiment, the female and the male member form the legs of the shapes.

In still another embodiment, the two-part case is a fenestrated case.

Moreover, each of the cassette receiving parts in one embodiment comprises an cassette enclosing member for receiving at least one cassette corner, which cassette enclosing member forms a cavity having a right-angle triangle shape with the two smaller sides of the triangle closed and a cassette corner receiving opening along the hypotenuse of the triangle for receiving the cassette corner. In another embodiment, each of the cassette receiving parts comprises an cassette enclosing member for receiving at least one cassette side, which cassette enclosing member has an U-profile shape and closed ends such that the cassette side and its adjoining corners are able to be enclosed thereby.

Moreover, the anti-theft safer in another embodiment of comprises an electronic article surveillance (EAS) tag.

Furthermore, a cassette receiving part for an anti-theft safer according to the invention is characterized in that the cassette receiving part is a first cassette receiving half of a two-part cassette receiving case. Moreover, a cassette receiving part for an anti-theft safer according to the invention is characterized in that the cassette receiving part is a second cassette receiving half of a two-part cassette receiving case.

In accordance with the invention, the improved security device for cassettes simplifies the manipulation, handling and assembly of a security device for cassettes, enhances the degree of security of the security device, and reduces the number of separate components that is required to form the security device. Furthermore, the inventive security device is cheap, especially to manufacture, light-weight, whereby the costs for transporting the security device is reduced, and adaptable, especially to cassettes with different dimensions. The security device reduces the number of components to be assembled for forming the device, whereby the assembly and maintenance are simplified and the associated costs for this reduced, and the storage of the components for the device simplified. Moreover, by providing the security device with a two-part case, only one part has to be replaced if broken compared to prior art safer cases where the whole case must be replaced. The invention also simplifies handling of the safer due to the fact that the whole case is formed by two complementary parts or halves that always are coupled and held together after assembly, i.e. the parts or halves is non-detachable after being assembled together, whereby for example no loose part is lost when an empty safer is stored before a reload of a new cassette or no loose part must be introduced or fitted into another part with a narrow opening when securing a cassette in the inventive safer. This saves time and effort for cashiers at a pay desk by simplifying the handling of the inventive safer compared to prior art safers as individual and loose safer parts are eliminated.

BRIEF DESCRIPTION OF THE DRAWINGS

The invention will be described in more detail below with reference to examples of embodiments and with reference to the attached drawings, of which

DETAILED DESCRIPTION OF EMBODIMENTS

Figure 1:
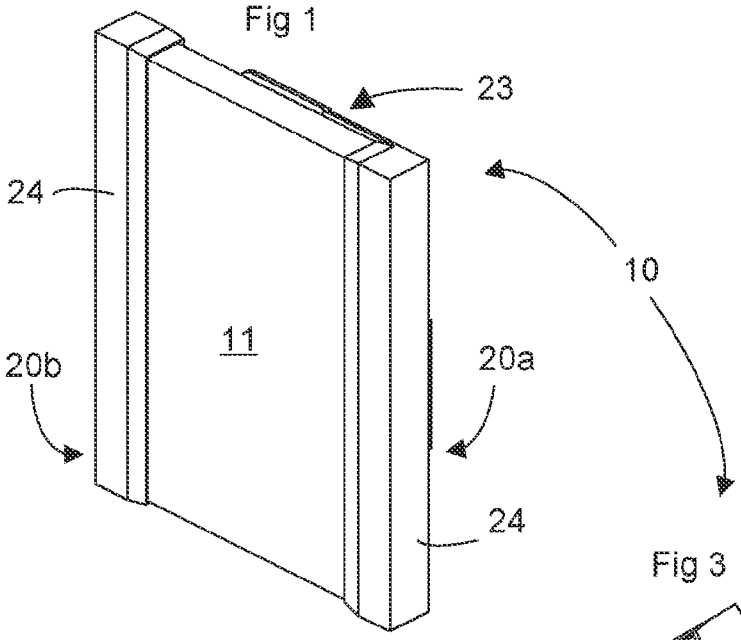
FIGS. 1 to 3 show different perspective views of an embodiment of the safer according to the invention in a locked state securing a cassette therein.
Figure 2:
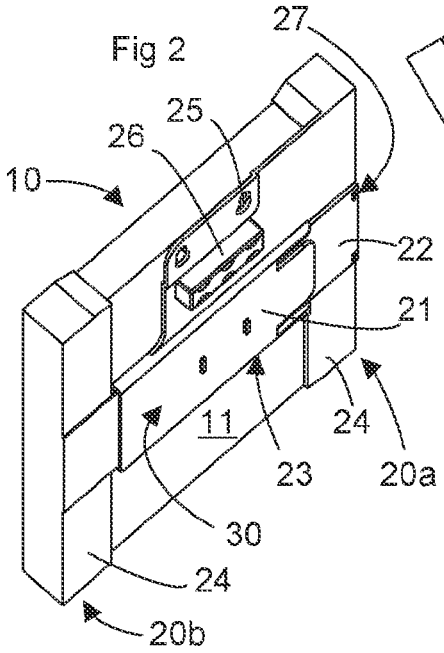
Figure 3:
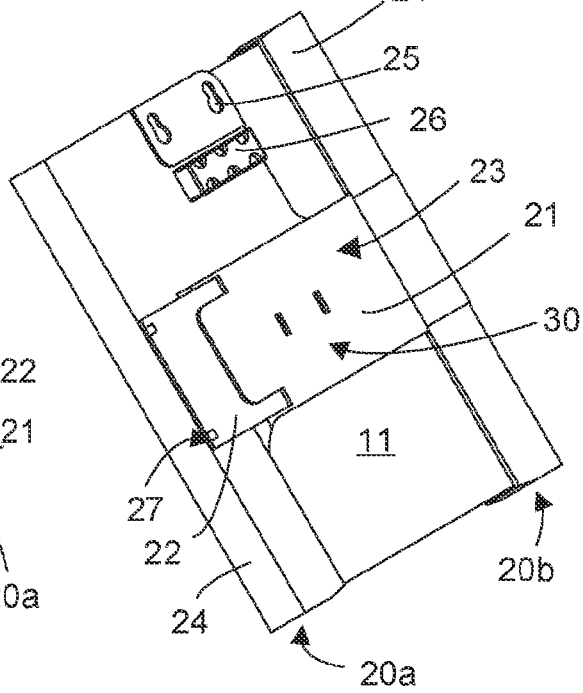

Referring to FIGS. 1 to 3, perspective views of an embodiment of the present invention are shown from different angles, wherein the security or anti-theft device according to the invention in general is denoted as 10. The security device 10 is an anti-theft and tamper-proof safer for a cassette/box 11 comprising a cassette receiving case 20 and a locking device 30 being adapted to releasably secure the cassette in the case. The cassette 11 may be a box for CD's, DVD's, or any other storage means with any square shape and any suitable dimensions but is preferably parallellepipedic and equipped with two flat sides, i.e. one front and one back, and four narrow sides, which narrow sides of course may be thinner or thicker than those narrow sides shown in FIGS. 1-3, and also in relation to the sizes, i.e. the dimensions of the two flat sides. The flat sides may also be quadratic instead of rectangular as shown, the flat sides may be adapted for a CD-box instead of a DVD-box 11 that is shown in FIGS. 1-3, or the case 20 may be adapted for a CD- or DVD-box with several CD's or DVD's, e.g. two CD's or DVD's having a thickness being two times the shown thickness, three CD's or DVD's with a thickness being three times the shown thickness, or four or more CD's or DVD's with a thickness being four times thicker or more than the embodiment shown, or any other media storing box for displaying an envelope of a box for purchase, or have any other suitable sizes and shapes. Moreover, the case 20 may also enclose the short sides of the DVD-box, i.e. the cassette 11, instead of the long sides as shown, if desired.

The cassette receiving case 20 according to the invention is a two-part case comprising a first cassette receiving part 20*a* and a second cassette receiving part 20*b*, which parts are adapted to releasably lock together with the locking device 30 for forming the case as one unit. These parts 20*a*, 20*b* are two in relation to each other movable parts, which parts are always coupled together forming a non-detachable unit after the assembly of the case, even in the unlocked state of the safer 10. This means that the two cassette receiving parts 20*a*, 20*b* are two case halves, i.e. the case 20 is divided in a first half 20*a* and a second half 20*b*, which halves are working together with the locking device 30 for securing the cassette 11 in the two-part case 20 and form the whole non-detachable case 20 after assembly.

According to embodiments of the invention, and compared to prior art safers, the locking device 30 is arranged differently and is an integrated part of the case 20. The locking device detachably and/or releasably interlocks the two case parts 20*a*, 20*b* for forming the case both in the cassette securing position when the locking device is locked in a closed state of the safer 10 for holding and securing the cassette and during cassette release/removement or insertion/introduction when the locking device is unlocked in an open state of the safer. The locking device 30 therefore indirectly, i.e. without any separate and additional latch member (not shown) or separable covers or lids as in prior art safers, which latch member and cover contacts the cassette and which is directly effected and controlled by means of the locking device 30, also secures the cassette 11 by means of the case itself, i.e. the two-part case, eliminating the need for the additional latch or detent member or separate covers or lids as in prior art safers.

Figures 4, 5, 6:
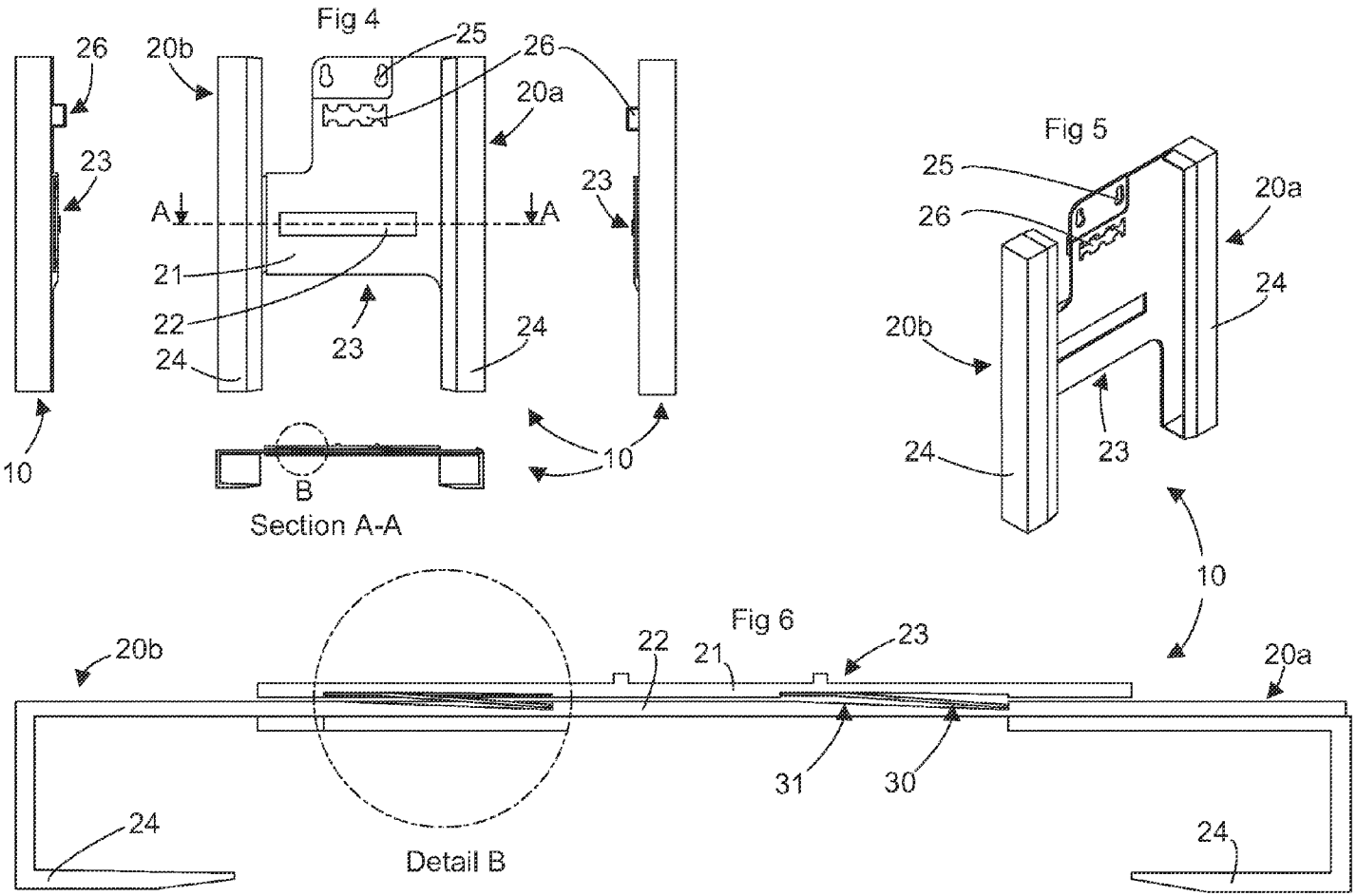
FIG. 4 shows two side views and a front view of an embodiment of the present invention in the locked state but empty without a cassette.
FIG. 5 is a perspective view of the embodiment of the invention in FIG. 4.
FIG. 6 is sectional views with different enlargements of the invention taken along line A-A wherein the invention is in the locked state of FIG. 4.
Figures 7, 8, 9:
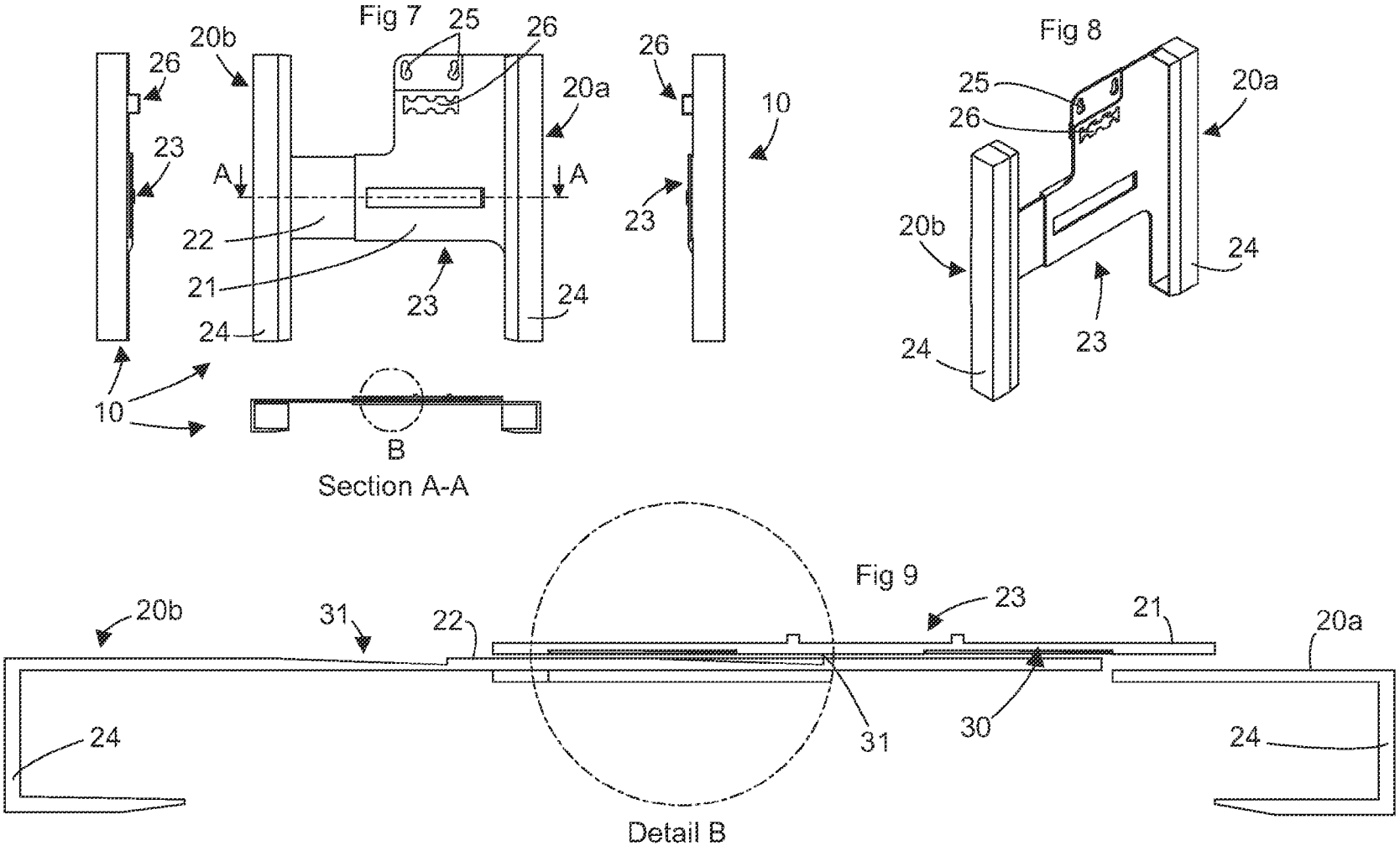
FIG. 7 shows two side views and a front view of the embodiment of the present invention in FIG. 4 wherein the invention is in an unlocked state and empty without a cassette.
FIG. 8 is a perspective view of the invention according to FIG. 7.
FIG. 9 is sectional views with different enlargements of the invention taken along line A-A wherein the invention is not in the locked state of FIG. 7.

According to the invention, the case forming and cassette receiving parts 20*a*, 20*b* are movably interconnected, such that the parts are displaceable in opposite directions in relation to each other to allow introducing or removing of the cassette 11 when the locking device 30 is released (shown in FIGS. 7-9) opening the safer 10, and fixed in relation to each other for holding and securing the cassette when the locking device is locked (shown in FIGS. 4-6) closing the safer, but the parts 20*a*, 20*b* are always connected or joined together as integrated parts being movable in relation to each other in the open safer state.

The configuration of the case 20 in accordance with the invention makes at least one dimension of the case adjustable, meaning that a box being smaller, i.e. in one dimension, e.g. the height or width is smaller than the box for which the case is adapted in size, may anyhow be securely held, of course within limits. This means that if the safer cases 20 for CD-boxes is out of stock in a store, safer cases 20 for DVD-boxes can be used, as the width and thickness of a CD-box is close to the width and thickness of a DVD-box while the height of the CD-box is smaller, due to the fact that the two case forming and cassette receiving parts 20*a*, 20*b* are displaceable in opposite directions in relation to each other such that the CD-box may be securely held by the safer 20 even though the CD-box slide inside the case 20 in a direction in parallel with the long sides of the case 20 adapted for the longer or higher DVD-boxes, but is kept secured therebetween, i.e. between the long sides.

The first cassette receiving part 20*a* has a female member 21 extending in the direction of movement for the two cassette receiving parts 20*a*, 20*b* and facing a male member 22 of the second cassette receiving part 20*b*, which female and male members are configured for displaceable interconnection in opposite directions. In one embodiment, the members together form an intermediate case back 23 (shown in FIGS. 2-14). One of the members 21, 22, i.e. either of them, is provided with the locking device 30 for securing the other member when the locking device is locked. The locking device 30 is preferably placed and integrated in the case back 23 but may of course also be placed in a front if the case back instead would be arranged as the front, but this would mean that the front would worsen the visibility of the envelope surface of the cassette 11 or the front be made in a transparent material, preferably plastic.

The locking device 30 is arranged in the female member 21 of the first cassette receiving part 20*a* but may equally also be arranged in the male member 22 of the second cassette receiving part 20*b*. The locking device 30 comprises two spring leaf tongues of metal that are operated by means of an external magnet (shown in FIG. 23 as unlocked with dashed lines and locked with continuous lines) from the closed safer state, i.e. an engagement and locking state shown in FIGS. 1-6, 14-20, and 23 where the tongues are in engagement with cavities 31 in the case 20, i.e. cavities 31 in the male member 22 of the second case part 20*b* (the cavities 31 may also be placed in the female member 21) to the open safer state, i.e. a releasing and unlocking state shown in FIGS. 7-9, and 21-23. This is a known function of locking and unlocking safers 20 for CD- and DVD-boxes and will not be explained in more detail, but the structure of the arrangement of tongues 30 and cavities 31 differ from prior art as explained below.

Figure 23:
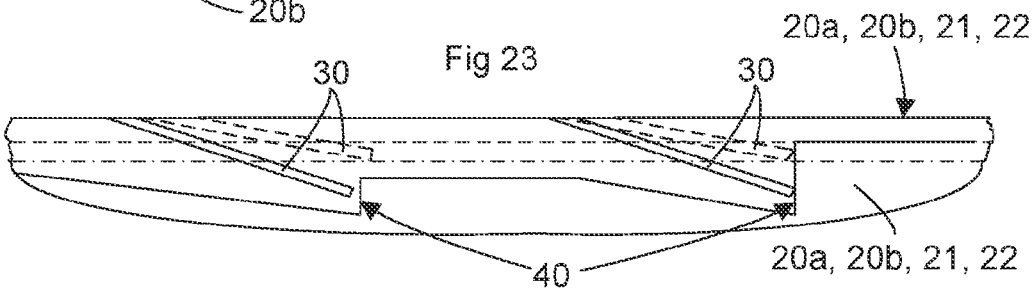
FIG. 23 is schematical view in section showing a locking device of the invention both in a locked or closed state and in an unlocked or open state.

In one embodiment of the safer 10, the cassette receiving parts 20*a*, 20*b* are coupled together by engagement between the locking device 30 and a retaining device 40 both when the locking device is locked and when the locking device is unlocked, this is schematically shown in FIG. 23. This retaining device 40 is provided in one embodiment by forming the cavities 31 as grooves in one of the parts 20*a*, 20*b* or members 21, 22 with a varying depth. In the shown embodiments, a pair of locking tongues 30 and a pair of grooves 31 engage each other in pairs for a better endurance against forceful shoplifting attempts. In one embodiment, two pairs of grooves 31 are used. In another embodiment each pair of grooves is arranged such that the pair of tongues 30 is able to oppose a first pair of grooves 31 and engage this first pair of grooves when the locking device 30 is locked in the closed safer state (when the cassette receiving parts 20*a*, 20*b* are displaced as close as possible to each other in the cassette securing position) shown to the left in FIG. 23, and oppose a second pair of grooves 31 and engage this second pair of grooves when the locking device 30 is unlocked in the open safer state (when the cassette receiving parts 20*a*, 20*b* are displaced as far as possible from each other in the cassette releasing and receiving position) shown to the right in FIG. 23. The grooves 31 in one embodiment have a substantially wedge-shaped cross-section when viewing the grooves from the side, i.e. in the plane of the case back 23. In the preferred embodiment, the locking device 30 with its tongues engages or abuts the back or trailing edge or heel of the corresponding grooves 31 such that the cassette receiving parts 20*a*, 20*b* are non-detachable, i.e. can not come loose from each other after assembly when trying to pull the parts apart, as shown to the right in FIG. 23.

In the preferred embodiment, the retaining device 40 has its grooves 31 shaped with a gradually varying depth in steps. This means in one embodiment that each groove has in principle two trailing edges or heels with different heights or depths (depending on from which direction the grooves are viewed) such that the locking device 30 is in engagement with one pair of trailing edges having a lower height or smaller depth when locked and in engagement with another pair of trailing edges with a higher height or larger depth when unlocked and the parts 20*a*, 20*b* are pulled as far as possible from each other. This difference in trailing edge height or depth between the grooves 31 provides the non-detachable function for the case 20 as the tongues of the locking device are always pulled in a constant distance (shown with a dash-dotted line in FIG. 23) by the magnetic force of the detacher when unlocked such that the tongues disengage from the first pair of trailing edges with a lower height to the left in FIG. 23, and the parts 20*a*, 20*b* are displaced until the tongues engage the second pair of trailing edges having another height, i.e. a greater height, one edge against one tongue, to the right in FIG. 23.

Figures 12, 13, 14, 15, 16, 17:
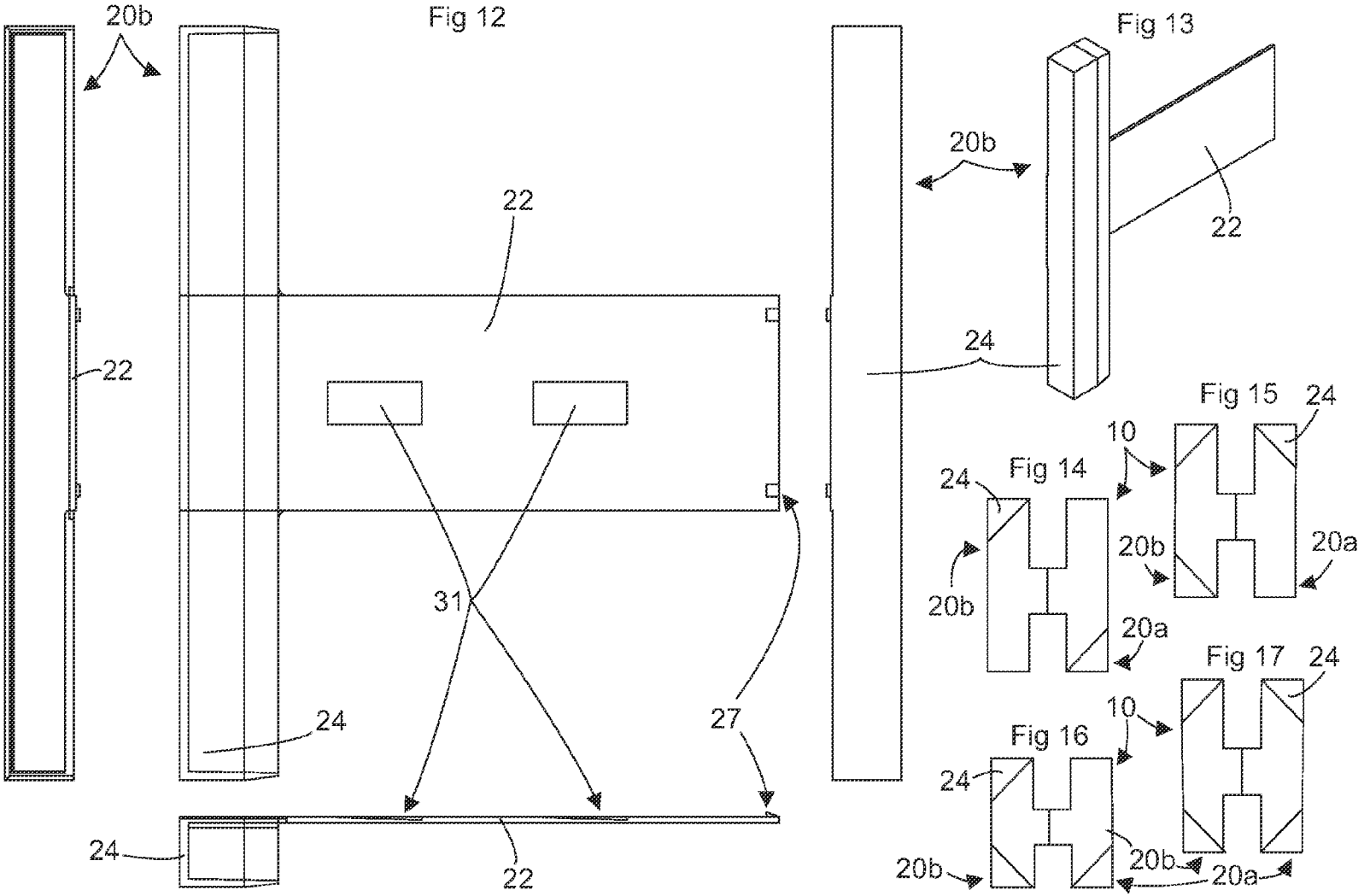
FIG. 12 shows two side views and a front view of a second part of yet another embodiment of the present invention.
FIG. 13 is a perspective view of the embodiment of the invention in FIG. 12, FIGS. 14 to 20 are schematical front views of other embodiments of the present invention.

Another embodiment of a retaining device 40 is shown in FIG. 12 in the form of two hooks 27, instead of grooves 31, at the free end of the male member 22 that is to be inserted into the female member 21 when assembled together. Here, the male member has a length greater than in the one shown in FIG. 9 such that when the safer 10 is opened by unlocking the locking device 30 and the members 21, 22 are pulled apart, the hooks 27 abut or engage the opening of the female member 21 at a maximum displacement, whereby the male member is hindered from further displacement from the female member and can not be pulled out there from.

Figures 18, 19, 20, 21, 22:
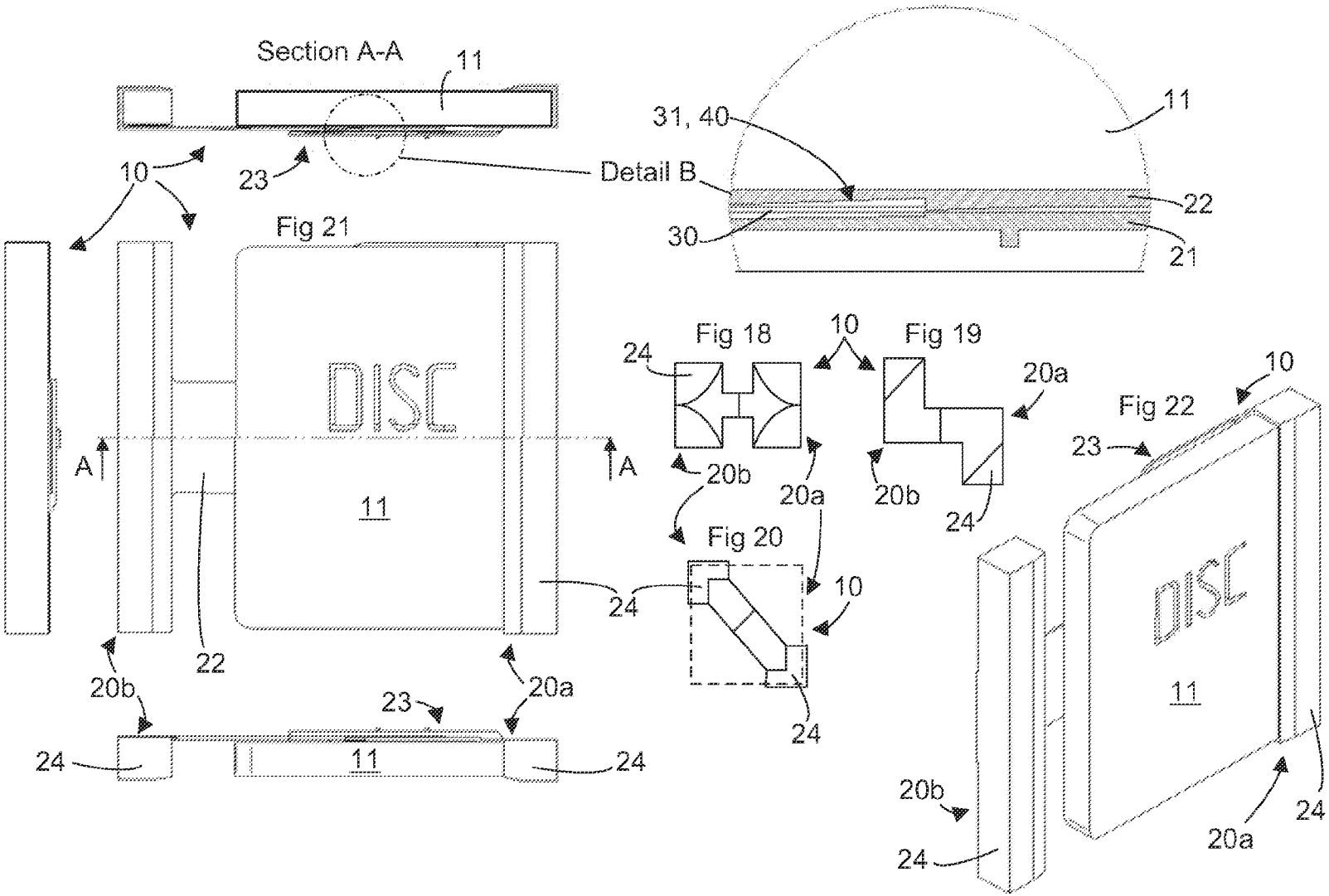
FIG. 21 shows one front view, one view from above, one side view, and one sectioned view from above of the invention in FIGS. 7-9 in a cassette release or introduction state with the first and second parts pulled aside to an end position fully opening the safer according to the invention.
FIG. 22 is a perspective view of the embodiment of the invention in FIG. 21.

In another embodiment of the invention, as shown schematically in a front view of the safer 10 in FIGS. 14 and 20, the two cassette receiving parts 20*a*, 20*b* are configured to enclose at least two corners of the cassette 11, which corners are arranged diagonally in relation to each other. Yet another embodiments are shown in FIGS. 15-16 where one embodiment has the first cassette receiving part 20*a* configured to securely enclose a first side of the cassette 11 and the adjoining corners of this first cassette side with the second cassette receiving part 20*b* configured to securely enclose a second cassette side opposite the first cassette side and at least one corner of this second cassette side when the locking device 30 is locked. In FIG. 17, an embodiment is shown where all four corners of the cassette 11 are enclosed. The embodiments in FIGS. 14-17 show the cassette receiving parts 20*a*, 20*b*, each part comprising at least one cassette enclosing member 24 for receiving at least one cassette corner, which cassette enclosing member forms a cavity having substantially the shape of a right-angle triangle with the two smaller sides of the triangle closed and a cassette corner receiving opening along the hypotenuse of the triangle for receiving the cassette corner. In FIG. 18 the cassette enclosing member 24 is rounded at one side and in FIG. 20 shaped as an L or V instead of a triangle for saving material. These embodiments are preferred if the material for manufacturing the safer 10 is to be reduced and the costs associated therewith reduced. This design saves plastic material and reduces the weight of the security device 10, and enhances the exposure of the cassette 11, while, at the same time, increasing the safety of the security device, i.e. makes it difficult to tamper with the device and the cassette that is protected by it.

Figure 11:
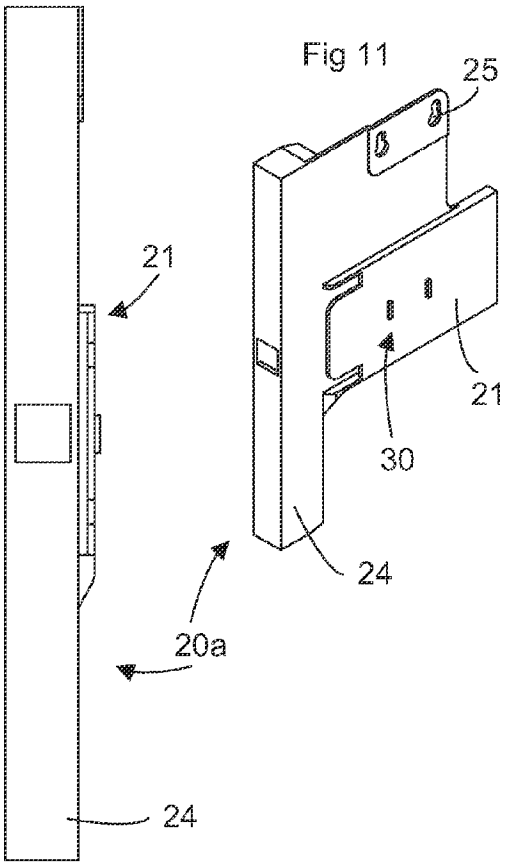
FIG. 11 is a perspective view of the embodiment of the invention in FIG. 10.
Figure 10:
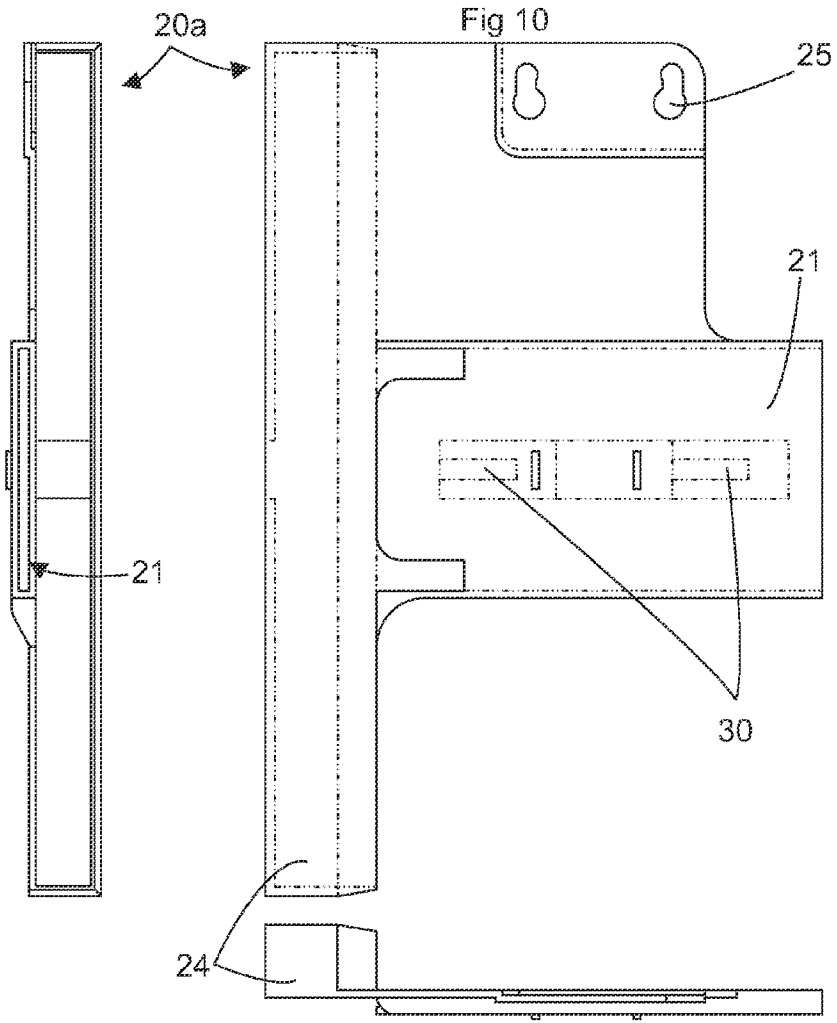
FIG. 10 shows two side views and a front view of a first part of another embodiment of the present invention.

In FIGS. 10-13, an embodiment shows the two cassette receiving parts 20*a*, 20*b* that form the case, i.e. FIGS. 10 and 11 shows the right part 20*a* in FIGS. 1-9 and FIGS. 12 and 13 shows the left part 20*b* in FIGS. 1-9. Each of the parts 20*a*, 20*b* has substantially the shape of a T in one embodiment (shown in FIGS. 17 and 18) or L in another embodiment (shown in FIG. 19) when viewed perpendicularly to the plane of the flat sides of the cassette 11. The female and the male member 21, 22 in the respective part 20*a*, 20*b* form the legs of the shapes in yet another embodiment.

Each of the female and male members 21 and 22 have a thickness that is smaller than its width, i.e. the thickness is preferably small to achieve a thin sheet-like structure and the width is preferably large, e.g. at least one fifth or fourth of the height or length of the cassette 11 to create a sufficiently sturdy and tamper-proof structure. The thickness of the members 21 and 22 may be at least 0.2 mm, or between 0.2 and 10 mm, preferably between 0.3 and 5 mm, or more preferably between 0.4 and 4 mm.

The two-part case 20 according to one embodiment of the invention is a fenestrated case, this embodiment being schematically shown in FIG. 18 as a fenestrated version of the safer case shown in FIGS. 1-9. In another embodiment, the two cassette receiving parts 20*a*, 20*b* are fenestrated while the intermediate case back 23 has substantially the same shape and size as the flat sides of the cassette 11, i.e. the case back 23 substantially covers the whole back of the cassette (not shown), while in yet another embodiment, both the two cassette receiving parts 20*a*, 20*b* and the intermediate case back 23 are fenestrated, i.e. recessed by removing excessive material (as shown in FIGS. 2-5, 7-8, and 10-13). This fenestration saves plastic material and further reduces the weight of the security device 10 while keeping the high level of protection for the cassette 11.

FIGS. 4-9 show each of the cassette receiving parts 20*a*, 20*b* comprising the cassette enclosing member 24 for receiving at least one cassette side, where the cassette enclosing member has an U-profile shape with closed ends, in this embodiment an elongated U-profile or channel-shaped container for receiving and enclosing the cassette 11 between the legs of the U or channel, preferably in a close fit, more preferred a tight fit, such that the cassette side and its adjoining corners are able to be securely enclosed thereby.

The safer case 20 according to the invention may optionally be equipped with a suspension device, in this embodiment in the form of two keyhole-shaped openings 25 for hanging the case 20 on a wall or similar. These holes 25 are placed on the first case forming part 20*a* but may instead be placed on the other case forming part, i.e. the second part 20*b*. Moreover, in the embodiment of the safer 10 enclosing for example the long sides of a DVD cassette the suspension device is orientated as in FIGS. 2-5, 7-8, and 10-11, while in the embodiment of the safer enclosing for example the short sides of a DVD cassette the suspension device is orientated 90° in relation to the long side embodiment of the safer (not shown).

Moreover, there is shown an embodiment having a integrated cavity 26 or a bulge with an opening having a wave- or teeth-shaped contour in FIGS. 2-3, 4, 5, 7, and 8. In the shown embodiment, the bulge 26 is arranged at the back 23 of the safer 10, but could also be arranged at the front or at any side of the safer, i.e. any short or long side. This cavity or bulge 26 is adapted to be provided with an alarm device (not shown) that is securely held within the cavity by the profiled contour of the cavity opening. The alarm device may be of any known type used for safers 10 of this kind, e.g. an electronic article surveillance (EAS) tag, and comprises an alarm tag that is activated if the alarm tag is carried out from a defined area in a department store or a shop due to the fact that the alarm tag then, at the exit from said area, will leave an electromagnetic or electrostatic field maintained in said area, or is carried through such a field maintained between bows located one, at each side of an exit passage, in accordance with a well known technique applied in connection with alarm tags.

Furthermore, the security device 10 according to the inventions is made of a plastic material. One embodiment is made of a non-transparent plastic material, another embodiment is made of a transparent plastic material, and yet another embodiment is made of an opaque plastic material. The plastic material may be for example poly carbonate (PC) or polyurethane or any other suitable plastic material.

In one embodiment of the invention comprising the first and second "receptacle" parts 20*a*, 20*b* for receiving a corner portion of the cassette 11, the first receptacle part 20*a* is attached, preferably integrally, to the first elongate locking member 21, the second receptacle part 20*b* being attached, preferably integrally, to the second elongate locking member 22, wherein said first locking member 21 is arranged to be slideably connected with said second locking member 22 and being slideable into and out of said second locking member, thereby narrowing and widening a distance between the first and second receptacle parts 20*a*, 20*b* such that in a maximum open/wide position it is possible to place the cassette 11 between the receptacle parts and in a maximum narrowed position the cassette is secured and withheld between/within said receptacle parts 20*a*, 20*b*, and where the locking members 21, 22 are lockable relatively to each other in the narrowed position by means of the locking device 30. The first and second locking members 21, 22 are attached to the receptacle parts 20*a*, 20*b* such that said locking members face a broad/wide side/face of the cassette.

In another embodiment of the invention, the safer 10 comprises the first and the second receiving receptacle 20*a*, 20*b* for receiving at least a part of an edge or corner portion of a cassette 11.

The invention claimed is:

1. An anti-theft safer for a cassette comprising a cassette receiving case and a locking device adapted to releasably secure the cassette inside the case, which cassette receiving case is a two-part case comprising a first cassette receiving case half and a second cassette receiving case half, which first cassette receiving case half and second cassette receiving case half together form an outer anti-theft safer for at least partially enclosing the cassette, wherein the locking device is comprised in any of the case halves which case halves are adapted to releasably lock together with the locking device for forming the cassette receiving case as one unit and for securing the cassette in the cassette receiving case, wherein the cassette receiving case halves are non-detachably coupled together after assembly for forming the case as a non-detachable unit both in the cassette securing position, when the locking device is locked in a closed state of the safer, and during cassette release or insertion, when the locking device is unlocked in an open state of the safer, wherein the case forming and cassette receiving halves are movably interconnected, such that the case halves are displaceable by sliding the halves in opposite directions in relation to each other in each open state of the safer when the locking device is unlocked and fixed in relation to each other in each closed state of the safer when the locking device is locked, wherein the outer anti-theft safer is configured to at least partially enclose two opposing side edges and opposing top and bottom edges of the cassette, wherein the cassette receiving case halves are coupled together by engagement between at least one tongue of the locking device and at least two grooves of a retaining device, wherein the at least one tongue engages at least a first one of the at least two grooves having a first depth when the locking device is locked in the closed safer state, and wherein the at least one tongue engages at least a second one of the at least two grooves having a second depth greater than the first depth of the first one of the at least two grooves when the locking device is unlocked in the open safer state.

2. An anti-theft safer for a cassette comprising a cassette receiving case and a locking device adapted to releasably secure the cassette in the case, which cassette receiving case is a two-part case comprising a first cassette receiving case half and a second cassette receiving case half, which first cassette receiving case half and second cassette receiving case half together form an outer anti-theft safer for at least partially enclosing the cassette, wherein the locking device is comprised in any of the case halves which case halves are adapted to releasably lock together with the locking device for forming the cassette receiving case as one unit and for securing the cassette in the cassette receiving case, wherein the cassette receiving case halves are non-detachably coupled together after assembly for forming the case as a non-detachable unit both in the cassette securing position, when the locking device is locked in a closed state of the safer, and during cassette release or insertion, when the locking device is unlocked in an open state of the safer, wherein the case forming and cassette receiving halves are movably interconnected, such that the case halves are displaceable by sliding the halves in opposite directions in relation to each other in each open state of the safer when the locking device is unlocked and fixed in relation to each other in each closed state of the safer when the locking device is locked, wherein the first cassette receiving case half has a female member extending in the direction of displacement for the two cassette receiving case halves and facing a male member of the second cassette receiving case half, which female and male members are configured for displaceable interconnection by sliding in opposite directions wherein the outer anti-theft safer is configured to at least partially enclose at least two opposing ends of the cassette, wherein the female and male members together form an intermediate case back interconnecting the two cassette receiving halves for covering at least parts of an envelope surface of the cassette between and at each of the two opposing ends of the cassette wherein the cassette receiving case halves are coupled together by engagement between at least one tongue of the locking device and at least two grooves of a retaining device, wherein the at least one tongue engages at least a first one of the at least two grooves having a first depth when the locking device is locked in the closed safer state, and wherein the at least one tongue engages at least a second one of the at least two grooves having a second depth greater than the first depth of the first one of the at least two grooves when the locking device is unlocked in the open safer state.

3. An anti-theft safer according to claim 1, wherein the locking device is an integrated part of the cassette receiving case.

4. An anti-theft safer according to claim 2, wherein the locking device is an integrated part of the intermediate case back.

5. An anti-theft safer according to claim 1, wherein one of the cassette receiving case halves is provided with the retaining device for engagement with the locking device on the other case half for holding the case halves together.

6. An anti-theft safer according to claim 3, wherein the cassette receiving case halves are coupled together by engagement between the at least one tongue of the locking device and the at least two grooves or hook of the retaining device, and wherein one of the members is provided with the retaining device for engagement with the locking device on the other member for holding the members together.

7. An anti-theft safer according to claim 1, wherein each of the parts of the two-part case has substantially the shape of a T.

8. An anti-theft safer according to claim 1, wherein each of the halves of the two-part case has substantially the shape of a L.

9. An anti-theft safer according to claim 2, wherein each of the halves of the two-part case has substantially the shape of a L, and in which shape the female and the male member form the legs of the shapes.

10. An anti-theft safer according to claim 1, wherein the two-part case is a fenestrated case.

11. An anti-theft safer according to claim 1, wherein each of the cassette receiving case halves comprises a cassette enclosing member for receiving at least one cassette corner, which cassette enclosing member forms a cavity having a right-angle triangle shape, the right-angle triangle shape having two smaller sides closed and a cassette corner receiving opening along a hypotenuse for receiving the cassette corner.

12. An anti-theft safer according to claim 1, wherein each of the cassette receiving case halves comprises an cassette enclosing member for receiving at least one cassette side, which cassette enclosing member has an U-profile shape and closed ends such that the cassette side and its adjoining corners are able to be enclosed thereby.

13. An anti-theft safer according to claim 1, comprising an electronic article surveillance (EAS) tag.

14. An anti-theft safer according to claim 1, wherein the case halves are displaceable by sliding the halves in parallel opposite directions in relation to each other.

15. An anti-theft safer for a cassette comprising a cassette receiving case and a locking device adapted to releasably secure the cassette inside the case, which cassette receiving case is a two-part case comprising a first cassette receiving case half and a second cassette receiving case half, which first cassette receiving case half and second cassette receiving case half together form an outer anti-theft safer for at least partially enclosing the cassette, wherein the locking device is comprised in any of the case halves which case halves are adapted to releasably lock together with the locking device for forming the cassette receiving case as one unit and for securing the cassette in the cassette receiving case, wherein the cassette receiving case halves are non-detachably coupled together after assembly for forming the case as a non-detachable unit both in the cassette securing position, when the locking device is locked in a closed state of the safer, and during cassette release or insertion, when the locking device is unlocked in an open state of the safer, wherein the case forming and cassette receiving halves are movably interconnected, such that the case halves are displaceable by sliding the halves in opposite directions in relation to each other in each open state of the safer when the locking device is unlocked and fixed in relation to each other in each closed state of the safer when the locking device is locked, wherein the outer anti-theft safer is configured to at least partially enclose at least two opposing ends of the cassette, wherein a female and a male member together form an intermediate case back interconnecting the two cassette receiving halves for covering at least parts of an envelope surface of the cassette between and at each of the two opposing ends of the cassette wherein the cassette receiving case halves are coupled together by engagement between at least one tongue of the locking device and at least two grooves of a retaining device, wherein the at least one tongue engages at least a first one of the at least two grooves having a first depth when the locking device is locked in the closed safer state, and wherein the at least one tongue engages at least a second one of the at least two grooves having a second depth greater than the first depth of the first one of the at least two grooves when the locking device is unlocked in the open safer state.

* * * * *